US008389065B2

(12) United States Patent
Kariyasu et al.

(10) Patent No.: US 8,389,065 B2
(45) Date of Patent: Mar. 5, 2013

(54) ROLL COATING APPARATUS AND METHOD FOR PRODUCING A COATED METAL STRIP

(75) Inventors: Takahiro Kariyasu, Fukuyama (JP); Masahide Morikawa, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 190 days.

(21) Appl. No.: 13/060,512

(22) PCT Filed: Aug. 25, 2009

(86) PCT No.: PCT/JP2009/065138

§ 371 (c)(1),
(2), (4) Date: Feb. 24, 2011

(87) PCT Pub. No.: WO2010/024424

PCT Pub. Date: Mar. 4, 2010

(65) Prior Publication Data

US 2011/0151130 A1 Jun. 23, 2011

(30) Foreign Application Priority Data

Aug. 26, 2008 (JP) ..... 2008-216452

(51) Int. Cl.
*B05D 1/28* (2006.01)
*B05C 1/06* (2006.01)

(52) U.S. Cl. ..... 427/428.01

(58) Field of Classification Search ..... 427/9, 428.01, 427/428.21; 118/258, 712
See application file for complete search history.

(56) References Cited

U.S. PATENT DOCUMENTS 3,283,707 A * 11/1966 Greubel et al. ..... 101/148
3,397,675 A * 8/1968 De Ligt ..... 118/258
5,743,964 A * 4/1998 Pankake ..... 118/712
2007/0163492 A1* 7/2007 Michelbrink et al. ..... 118/249

FOREIGN PATENT DOCUMENTS

JP 1982-131869 U 8/1982
JP 5-309305 A 11/1993

OTHER PUBLICATIONS

International Search Report (ISR) dated Nov. 24, 2009 (in English) in parent International Application No. PCT/JP2009/065138.

* cited by examiner

*Primary Examiner* — Nathan Empie
(74) *Attorney, Agent, or Firm* — Holtz, Holtz, Goodman & Chick, PC

(57) ABSTRACT

There is provided a roll coating apparatus and method for producing a coated metal strip. The roll coating apparatus presses a roll against the surface of a metal strip and coats the metal strip with a coating fluid, and is capable of adequately adjusting the pressure force of the roll so that it is uniform in the width direction of the roll, while maintaining the overall rigidity of stands that support the roll. A connecting member 15 connects an applicator roll support unit 11*a* in a right stand 1*a* and an applicator roll support unit 11*b* in a left stand 1*b*, and a connecting member movement mechanism 16*a* is provided between the right end of the connecting member 15 and the applicator roll support unit 11*a* in the right stand 1*a*, making it possible for the connecting member 15 to move in the direction of pressure against the metal strip.

13 Claims, 5 Drawing Sheets

(a)

(b)

ROLL COATING APPARATUS AND METHOD FOR PRODUCING A COATED METAL STRIP

This application is a U.S. National Phase Application under 35 USC 371 of International Application PCT/JP2009/065138 filed Aug. 25, 2009.

FIELD OF THE INVENTION

The present invention relates to a roll coating apparatus (roll coater) that coats the surface of a metal strip, and to a method for producing a coated metal strip.

RELATED ART

Various methods are known as a method for continuously coating a metal strip such as a steel plate or aluminum plate, however, when coating with a relatively thin film, a roll coating apparatus (roll coater) that presses a roll again the surface of the metal strip and applies a coating fluid is widely used. Typically, a plurality of rolls is arranged in the roll coating apparatus, with both ends of these rolls (hereafter, expressed as right and left (in the direction of advancement of the metal strip)) being supported by stands (left and right stands) by way of roll chocks that are equipped with bearings, and the thickness of the coating film is regulated by adjusting the applied pressure (nip pressure), gap and circumferential speed of the rolls (circumferential speed ratio between rolls) between the metal strip and rolls and between rolls.

These conditions for achieving a desired film thickness are set beforehand according to values from experience, however, even when set to the same conditions, the values of the thickness may vary up or down depending on the surface conditions of the rolls or the plate thickness and surface condition of the metal strip, so it is necessary to perform fine adjustment of the set conditions so that the actual film thickness values after line operation are the desired film thickness.

When doing this, in order to increase or decrease the film thickness over the entire width direction, often the gap between rolls, or the circumferential speed of the rolls (circumferential speed ratio between rolls) is changed, however, when the film thickness is uneven in the width direction, it is necessary to change the balance of the pressure force on the left and right between rolls. In order to do that, it is necessary to perform adjustment while operating the line, so in order to move each roll freely back and forth in the direction of pressure against the metal strip (direction orthogonal to the surface of the metal strip), the apparatus comprises a pressure mechanism and a movement mechanism (for example, refer to patent document 1 to 5).

Moreover, in order to perform these movements quickly and accurately, often a servomotor or the like is used to make automatic movement possible, and in order for the pressure mechanism and movement mechanism to uniformly adjust uneven film thickness in the width direction of the metal strip, usually one set of mechanisms is independently provided on each end of a roll with the purpose of separately controlling the pressure force by the left and right of a roll.

In addition, the stands that support the rolls oppose the roll pressure force and vibration from the metal strip, so the stands on both the left and right are connected and integrated with the purpose of increasing rigidity of the entire stand.

A perspective drawing of a single-surface-coating type three-roll coating apparatus is illustrated in FIG. 6 and FIG. 7 as a typical example of this kind of roll coating apparatus. Here, FIG. 6 illustrates the state in which rolls are not installed in the stands, and FIG. 7 illustrates the state in which rolls are installed in the stands.

As illustrated in FIG. 6 and FIG. 7, this kind of single-surface coating type three-roll coating apparatus comprises: a pick-up roll 20 that draws coating fluid from a coating pan (not shown in the figure) that is filled with coating fluid; a metering roll 30 that adjusts the amount of coating fluid that is drawn by the pick-up roll 20, and an applicator roll 10 that receives coating fluid from the metering roll 30, the amount of which has been adjusted, and transfers that fluid to a metal strip 9. In FIG. 7, reference number 40 is a backup roll.

The right end and left end of each roll 10, 20, 30 are supported by a right stand 1*a* and left stand 1*b* by way of roll chocks that are equipped with internal bearings, and each roll 10, 20, 30 comprises a pressure mechanism and movement mechanism such that the rolls can freely move in the direction of pressure against the metal strip.

In other words, the right end and left end of the applicator roll 10 are respectively supported by an applicator roll chock 12*a* that is provided in an applicator roll support unit 11*a* of the right stand 1*a*, and an applicator roll chock 12*b* that is provided in an applicator roll support unit 11*b* of the left stand 1*b*. In addition, an applicator roll pressure mechanism 13*a* is provided in the applicator roll support unit 11*a* of the right stand 1*a*, and an applicator roll pressure mechanism 13*b* is provided in the applicator roll support unit 11*b* of the left stand 1*b*, as well as an applicator roll movement mechanism 14*a* is provided between a base mounting unit 2*a* and applicator roll support unit 11*a* of the right stand 1*a*, and an applicator roll movement mechanism 14*b* is provided between a base mounting unit 2*b* and applicator roll support unit 11*b* of the left stand 1*b*. The applicator roll pressure mechanisms 13*a*, 13*b* and applicator roll movement mechanisms 14*a*, 14*b* are such that they can freely move the applicator roll 10 in the direction of pressure against the metal strip.

Similarly, the right end and left end of the pick-up roll 20 are respectively supported by a pick-up roll chock 22*a* that is provided in a pick-up roll support unit 21*a* of the right stand 1*a*, and a pick-up roll chock 22*b* that is provided in a pick-up roll support unit 21*b* of the left stand 1*b*. Moreover, a pick-up roll pressure mechanism 23*a* is provided in a pick-up roll support unit 21*a* of the right stand 1*a*, and a pick-up roll pressure mechanism 23*b* is provided in a pick-up roll support unit 21*b* of the left stand 1*b*, as well as a pick-up roll movement mechanism 24*a* is provided between the applicator roll support unit 11*a* and pick-up roll support unit 21*a* of the right stand 1*a*, and a pick-up roll movement mechanism 24*b* is provided between the applicator roll support unit 11*b* and the pick-up roll support unit 21*b* of the left stand 1*b*. The pick-up roll pressure mechanisms 23*a*, 23*b* and the pick-up roll movement mechanisms 24*a*, 24*b* are such that they can freely move the pick-up roll 20 in the direction of pressure against the metal strip.

Similarly, the right end and left end of the metering roll 30 are respectively supported by a metering roll chock 32*a* that is provided in the right stand 1*a* and a metering roll chock 32*b* that is provided in the left stand 1*b*. Moreover, a metering roll pressure mechanism 33*a* is provided in the right stand 1*a* and a metering pressure mechanism 33*b* is provided in the left stand 1*b*, as well as a metering roll movement mechanism 34*a* is provided between the pick-up roll support unit 21*a* and the metering roll chock 32*a* of the right stand 1*a*, and a metering roll movement mechanism 34*b* is provided between the pick-up support unit 21*b* and the metering roll chock 32*b* of the left stand 1*b*. The metering roll pressure mechanisms 33*a*, 33*b* and the metering roll movement mechanisms 34*a*, 34*b* are such that they freely move the metering roll 30 in the direction of pressure against the metal strip.

Moreover, with the objective of increasing the overall rigidity of the stand, construction is such that the right stand 1*a* and left stand 1*b* are integrated by connecting the right stand 1*a* and left stand 1*b* by a connecting member 15. Here, the location of the connecting member 15 is not especially limited as long as the rigidity of the left and right stand 1*a*, 1*b* can be maintained, however, for example, as illustrated in the figures, the connecting member 15 can be located between the applicator roll support unit 11*a* and the applicator roll support unit 11*b*.

The left and right stands 1*a*, 1*b* are also connected by way of the rolls 10, 20, 30, however, normally, self-aligning bearings are used in the rolls 10, 20, 30, so that the amount of connection is very small.

In this kind of roll coating apparatus, the applicator roll 10 evenly presses the metal strip 9 over the entire width direction of the roll, and as long as each of the rolls 10, 20, press evenly over the entire width direction of the rolls, a uniform coating film thickness can be obtained in the width direction, however, when the pressure force on either the left or right end of the rolls 10, 20, 30 is strong (partial contact), or when the shape of the metal strip 9 itself is uneven in the width direction, it is not possible to maintain a uniform pressure in the width direction of the rolls, so the coating film thickness in the width direction becomes uneven.

Therefore, the apparatus is provided with a pressure detection function such as a torque sensor or load sensor, and a pressure adjustment function (for example, refer to patent documents 2 to 5).

However, normally, the rolls 10, 20, 30 are driven by separate motors, and due to the construction, the load of the joint section for transmitting that drive force is placed on the stand on the drive side, so the difference in load becomes a difference in resistance to movement by the left and right stands, and as a result there is a loss of balance between the left and right pressure force of rolls, so there is a possibility that the coating film thickness will become uneven in the width direction.

In such a case, by clearly knowing how the film thickness will change according to how much the left and right pressure is changed, it is possible to adjust the film thickness in a short period of time, however, fine adjustment is not possible with the calculated pressure setting, and actually in order to balance the left and right pressure force of the rolls, it is necessary to perform adjustment so that the left and right are within the desired film thickness range by repeatedly changing the left and right pressure a little at a time and checking the film thickness. In addition, this kind of fine adjustment of the film thickness must be performed while the line is in operation. When doing this, as a method of measuring and checking the film thickness while online (line in operation) is a method of measuring the thickness of a water film that is not dry directly after coating and converting that thickness to a dry film thickness, however, the accuracy is poor, so in many cases, with the film in a dry state, the film thickness is converted by fluorescent X-ray analysis of the element, or by an infrared film thickness meter. In order to do this, fine adjustment of the film thickness and measurement of the film thickness are repeated, however, during this time, a problem occurs in that areas where there is variation in the film thickness are produced, causing a decrease in yield.

As described above, it is thought that a cause of not being able to adjust the balance in the left and right film thickness as calculated is that the left and right stands 1*a* and 1*b* are connected and integrated in order to increase the overall rigidity of the stand, so the pressure that is applied to the rolls 10, 20, 30 from one of the stands is transmitted to the other stand via the connecting member 15, and a pressure detection device (load cell, etc.) that is provided for detecting the pressure force of the rolls detects a force that is not the pressure force of the rolls.

A control method which measures the pressure load (pressure force) on the left and right of a roll using a load detection device (pressure detection device) such as a load cell, and minimizes the difference between the left and right pressure is widely used as a method for controlling the roll pressure (for example refer to patent document 6), however, in that case, as described above, there is a problem in that the force transmitted by the pressure on one side may be detected by the load detection device on the other side, and the pressure load on one side may affect the measurement value of the pressure force on the other side, thus the increased pressure force cannot be measured accurately, and the fine adjustment process described above for adjusting the film thickness (cycle of changing the pressure force→drying→measuring the film thickness) takes time. Moreover, portions where there was deviation from the reference film thickness when adjusting the film thickness cannot be made into a product so there is a problem in that there is a decrease in yield. In addition, there is a problem in that the faster the line speed is, these portions where there is deviation from the reference film thickness when adjusting the film thickness increase.

REFERENCE DOCUMENTS

Patent Documents

Patent document 1: Japanese utility model application No. S57-131869

Patent document 2: Japanese patent application No. S59-216656

Patent document 3: Japanese patent application No. H5-309305

Patent document 4: Japanese utility model application No. H2-117065

Patent document 5: Japanese patent application No. H4-126564

Patent document 6: Japanese patent application No. S58-067381

SUMMARY OF THE INVENTION

Problem to Be Solved By the Invention

Taking the aforementioned problems into consideration, the object of the present invention is to provide a roll coating apparatus and a method of producing a coated metal strip by using that roll coating apparatus, wherein the roll coating apparatus applies a coating fluid to a metal strip by pressing rolls against the surface of the metal strip, and is capable of adequately adjusting the pressure applied by the rolls in a short period of time such that the pressure applied by the rolls is uniform in the width direction of the rolls, while at the same time maintaining overall rigidity of stands that support the rolls.

Means for Solving the Problem

In order to solve the problems described above the present invention has the features described below.

[1] The present invention is a roll coating apparatus that presses a roll against a metal strip and coats the metal strip with a coating fluid characterized by a connecting member that connects between left and right stands that support the left and right ends of the roll, wherein that connecting member can move in the direction of pressure of the roll against the metal strip with respect to either the left or right stand or both stands.

[2] The present invention is a roll coating apparatus that presses a roll against a metal strip and coats the metal strip with a coating fluid characterized by a connecting member that connects between left and right stands that support the left and right ends of the roll, wherein that connecting member can slide in the direction of pressure of the roll against the metal strip with respect to either the left or right stand or both stands.

[3] The present invention is a roll coating apparatus that presses a roll against a metal strip and coats the metal strip with a coating fluid, comprising: a connecting member that connects between left and right stands that support the left and right ends of the roll; and a connecting member movement method in the connecting section between the connecting member and left or right stand or both stands that makes it possible for the connecting member to move in the direction of pressure of a roll against the metal strip.

[4] The present invention is the roll coating apparatus according to [3] above, wherein the connecting member movement means is a rolling self-guiding bearing.

[5] The present invention is the roll coating apparatus according to any one of [1] to [4] above, further comprising: a measurement method for measuring the film thickness value of film that is formed on the metal strip; and a control method to which the film thickness value and line speed value are input, and which adjusts the roll circumferential speed, gap between rolls and roll pressure so that the film thickness is within a preset range.

[6] The present invention is a method for producing a coated metal strip by using the roll coating apparatus of any one of [1] to [5] above to coat a coating fluid on the surface of a metal strip.

Effect of the Invention

The roll coating apparatus of the present invention is capable of adequately adjusting the pressure force of a roll so that the pressure is uniform in the width direction of the roll, while at the same time maintaining the overall rigidity of stands that support the roll. As a result, by producing a coated metal strip using the roll coating apparatus of the present invention, it is possible to adjust the film thickness in a short period of time and to obtain a coated metal strip having a uniform film thickness in the width direction.

MODES FOR CARRYING OUT THE INVENTION

A roll coating apparatus of an embodiment of the present invention will be explained based on the accompanying drawings. Here, a single-surface coating type 3-roll coating apparatus will be explained as an example.

Figure 1:
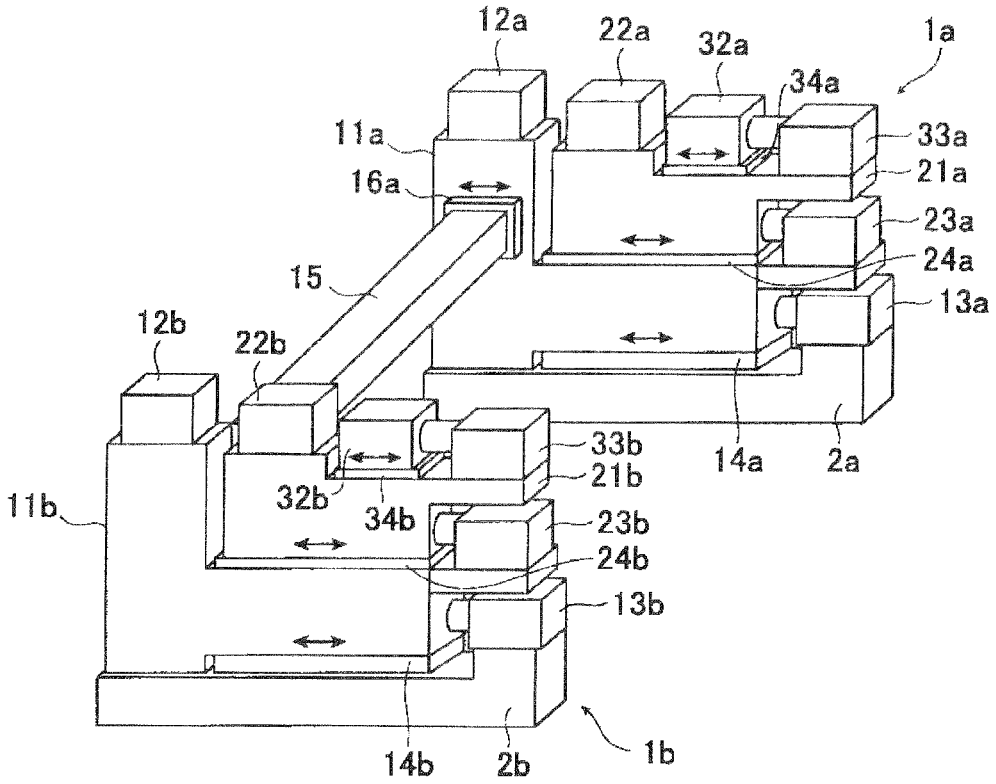
FIG. 1 is a perspective drawing of the roll coating apparatus of an embodiment of the present invention.
Figure 2:
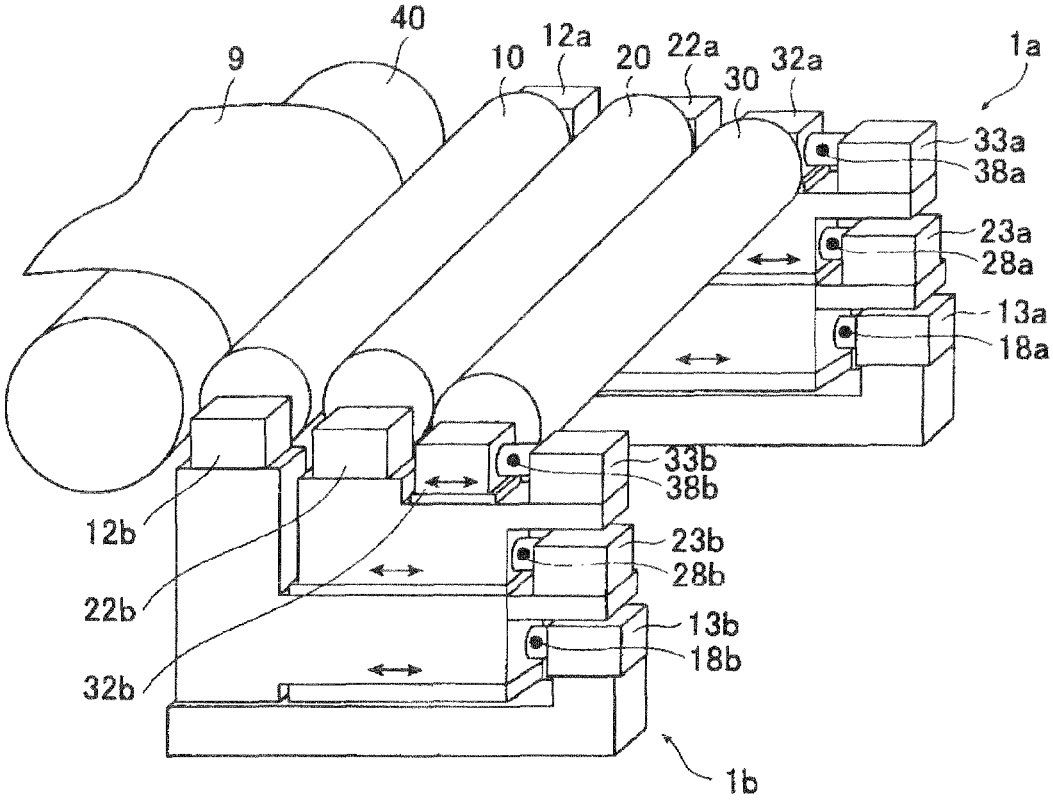
FIG. 2 is a perspective drawing of the roll coating apparatus of an embodiment of the present invention.

FIG. 1 and FIG. 2 are perspective drawings of a single-surface coating type 3-roll coating apparatus, where FIG. 1 illustrates the state in which the rolls are not installed in the stands, and FIG. 2 illustrates the state in which the rolls are installed in the stands.

Figure 6:
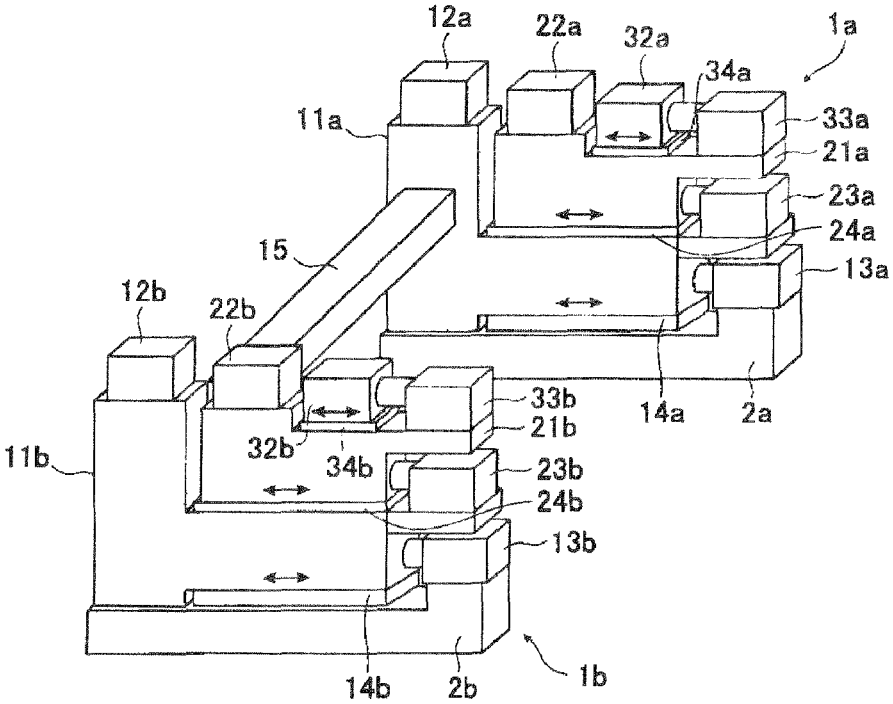
FIG. 6 is a perspective drawing of a conventional roll coating apparatus.
Figure 7:
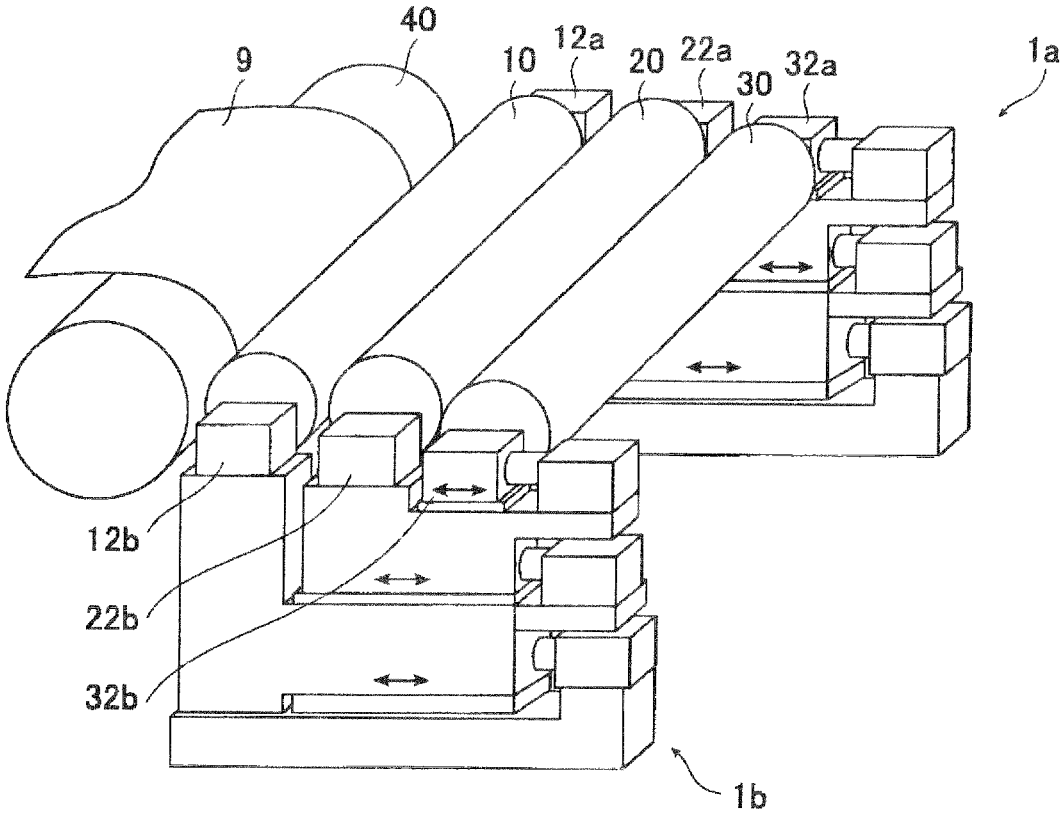
FIG. 7 is a perspective drawing of a conventional roll coating apparatus.

The single-surface coating type 3-roll coating apparatus of this embodiment basically has the same construction as the apparatus illustrated in FIG. 6 and FIG. 7, and as illustrated in FIG. 1 and FIG. 2, comprises: a pick-up roll 20 that picks up coating fluid from a coater pan (not shown in the figures) that is filled with coating fluid, a metering roll 30 that adjusts the amount of coating fluid that the pick-up roll 20 picks up, and an applicator roll 10 that receives the coating fluid, the amount of which was adjusted by the metering roll 30, from the pick-up roll 20 and transfers that coating fluid to a metal strip 9. In FIG. 2, reference number 40 is a backup roll.

The right ends and left ends of the rolls 10, 20 and 30 are supported by a right stand 1*a* and left stand 1*b*, and each of the rolls 10, 20 and 30 comprise a pressure mechanism and movement mechanism so that they can freely move in the direction of pressure against the metal strip.

In other words, the right end and left end of the applicator roll 10 are supported by an applicator roll chock 12*a* that is provided in an applicator roll support unit 11*a* of the right stand 1*a* and an applicator roll chock 12*b* that is provided in an applicator roll support unit 12*b* of the left stand 1*b*, respectively. Moreover, an applicator roll pressure mechanism 13*a* is provided in the applicator roll support unit 11*a* of the right stand 1*a* and an applicator roll pressure mechanism 13*b* is provided in the applicator roll support unit 11*b* of the left stand 1*b*, as well as an applicator roll movement mechanism 14*a* is provided between a base mounting unit 2*a* and the applicator roll support unit 11*a* of the right stand 1*a*, and an applicator roll movement mechanism 14*b* is provided between a base mounting unit 2*b* and applicator roll support unit 11*b* of the right stand 1*b*. The applicator roll pressure mechanisms 13*a*, 13*b* and applicator roll movement mechanisms 14*a*, 14*b* are such that they freely move the applicator roll 10 in the direction of pressure against the metal strip.

Similarly, the right end and left end of the pick-up roll 20 are supported by a pick-up roll chock 22*a* that is provided in a pick-up roll support unit of the right stand 1*a*, and a pick-up roll chock 22*b* that is provided in a pick-up roll support unit 21*b* of the left stand 1*b*, respectively. Moreover, a pick-up roll pressure mechanism 23*a* is provided in the pick-up roll support unit 21*a* of the right stand 1*a* and a pick-up roll pressure mechanism 23*b* is provided in the pick-up roll support unit 21*b* of the left stand 1*b*, as well as a pick-up roll movement mechanism 24*a* is provided between the applicator roll support unit 11*a* and pick-up roll support unit 21*a* of the right stand 1*a*, and a pick-up roll movement mechanism 24*b* is provided between the applicator roll support unit 11*b* and pick-up roll support unit 21*b* of the left stand 1*b*. The pick-up roll pressure mechanisms 23*a*, 23*b* and the pick-up roll movement mechanisms 24*a*, 24*b* are such that they freely move the pick-up roll in the direction of pressure against the metal strip.

Similarly, the right end and left end of the metering roll 30 are supported by a metering roll chock 32*a* that is provided in the right stand 1*a* and a metering roll chock 32*b* that is provided in the left stand 1*b*, respectively. Moreover, a metering roll pressure mechanism 33*a* is provided in the right stand 1*a* and a metering roll pressure mechanism 33*b* is provided in the left stand 1*b*, as well as a metering roll movement mechanism 34*a* is provided between the pick-up roll support unit 21*a* and the metering roll chock 32*a* of the right stand 1*a*, and a metering roll movement mechanism 34*b* is provided between the pick-up roll support unit 21*b* and the metering roll chock 32*b* of the left stand 1*b*. The metering roll pressure mechanisms 33*a*, 33*b* and metering roll movement mechanisms 34*a*, 34*b* are such that they freely move the metering roll 30 in the direction of pressure against the metal strip.

Here, as illustrated in FIG. 2, applicator roll pressure detection devices (load cells or the like) 18*a*, 18*b* for detecting the pressure by the applicator roll 10 against the metal strip 9 are provided in the applicator pressure mechanisms 13*a*, 13*b*, respectively; pick-up roll pressure detection devices (load cells or the like) 28*a*, 28*b* for detecting the pressure by the pick-up roll against the applicator roll 10 are provided in the pick-up roll pressure mechanisms 23*a*, 23*b*, respectively; and metering roll pressure detection mechanisms (load cells or the like) 38*a*, 38*b* for detecting the pressure of the metering roll 30 against the pick-up roll 20 are provided in the metering roll pressure mechanisms 33*a*, 33*b*, respectively.

Moreover, the applicator roll support unit 11*a* of the right stand 1*a* is connected with the applicator roll support unit 11*b* of the left stand 1*b* by way of a connecting member 15.

The right and left stands 1*a*, 1*b* are also connected by way of the rolls 10, 20 and 30, however, self-aligning bearings are used in the rolls 10, 20 and 30, so the amount of connection is very small.

In addition, in the single-surface coating type 3-roll coating apparatus of this embodiment, a connecting member movement mechanism 16*a* is provided between the right end of the connecting member 15 and the applicator roll support unit 11*a* of the right stand 1*a*, and this connecting member movement mechanism 16*a* is such that it freely moves the right end of the connecting member with respect to the applicator roll support unit 11*a* (relative movement) in the direction of pressure against the metal roll (hereafter, the X direction), and cannot move in the left-right direction between the stands (hereafter, the Y direction). On the other hand, the left end of the connecting member 15 is fastened to the applicator roll support unit 11*b* of the left stand 1*b*.

Figure 3A:
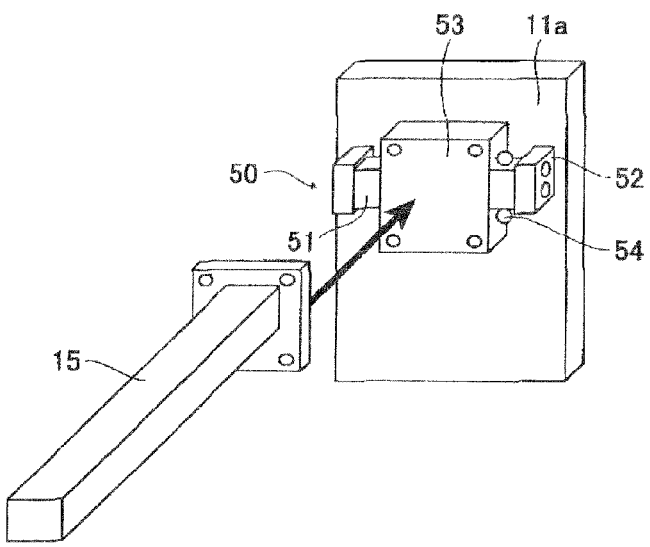
FIGS. 3A and 3B are drawings illustrating one example of a movement mechanism for a connecting member of an embodiment of the present invention.
Figure 3B:
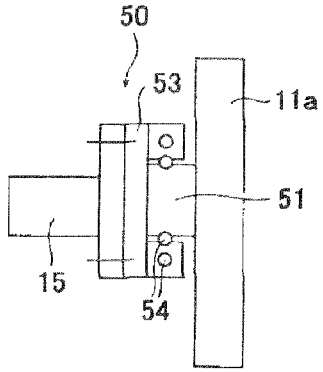

Incidentally, any construction is possible for the connecting member movement mechanism 16*a* as long as it is capable of free movement in the X direction and cannot move in the Y direction, however, for example, as illustrated in the perspective drawing of FIG. 3A and the cross-sectional drawing of FIG. 3B, a rolling direct-guiding bearing device 50, in which a saddle shaped moving member 53 that is attached to one member (here, this is the connecting member 15) moves by way of a ball 54 over a rail 51 that is attached to another member (here, this is the applicator roll support unit 11*a*) by a installation member 52, is very suitable. The use of a rolling direct-guiding bearing device in the movement mechanism 14*a*, 14*b*, 24*a*, 24*b*, 34*a* and 34*b* described above is also very suitable.

Figure 4:
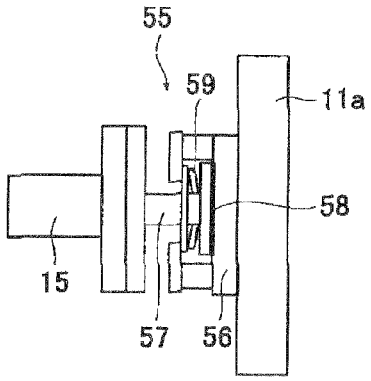
FIG. 4 is a drawing illustrating another example of a movement mechanism for a connecting member of an embodiment of the present invention.

In addition to the rolling direct-guiding bearing device 50 described above, the connecting member movement mechanism 16*a* can be a guide device 55 as illustrating in the cross-sectional drawing of FIG. 4 in which a guide member 56 is attached to the applicator roll support unit 11*a*, a moving member 57 is attached to the end section of the connecting member 15, and the moving member 57 is able to move with respect to the guide member 56 by way of a moving surface 58 in the direction that the roll applies pressure to the metal strip, as well as a spring washer is installed on the tip end of the moving member 57 so that there is constant thrust between the right stand 1*a* and left stand 1*b*.

In this way, the rigidity in the direction between the left and right stands is reinforced by the connecting member 15 that connects the right stand 1*a* and left stand 1*b*, and together with maintaining the overall rigidity of the stand, the pressure that is applied from one stand on the rolls 10, and 30 by the connecting member movement mechanism 16*a* that can move the connecting member 15 in the X direction against the right stand 1*a* is transferred to the other stand by way of the connecting member 15, so pressure that is not actual roll pressure no longer occurs on the other end of the rolls 10, 20 and 30, and it is possible to adequately adjust the pressure applied from the rolls 10, 20 and 30 so that it is uniform along the width of the rolls.

In other words, in the case of a roll coating apparatus, in order to obtain construction that moves the rolls in the direction of pressure against the metal strip (X direction) while at the same time supports the rolls, it is necessary to increase the size of the stand in the direction of pressure against the metal strip, so the apparatus has sufficient rigidity in the direction of pressure against the metal strip (X direction) of the left and right stands. However, when coating, each roll is pressed with a pressure that corresponds to the desired film thickness, so in order to hold each roll in the stands, due to the spatial relationship, the width (thickness) of the stands is often made narrow, so in many cases it becomes difficult to maintain rigidity of the individual left and right stand in the same direction as the width direction of the metal strip (Y direction).

Therefore, by connecting the left and right stands by way of the connecting member, and at the same time, providing a connecting member movement mechanism that makes it possible for the connection between the connecting member and the stands to move in the X direction, the connecting member functions as a rigid connecting member in the Y direction in which the rigidity is low, and by freely moving in the X direction in which there is sufficient rigidity, it is possible to maintain independence of the left and right stands. Moreover, when controlling the pressure force by providing load detection devices in the left and right stands, it is possible to eliminate the problem of not knowing the actual pressure force due to both the pressure load on the left and right having an effect, and thus taking a long time to adjust the film thickness.

Figure 5:
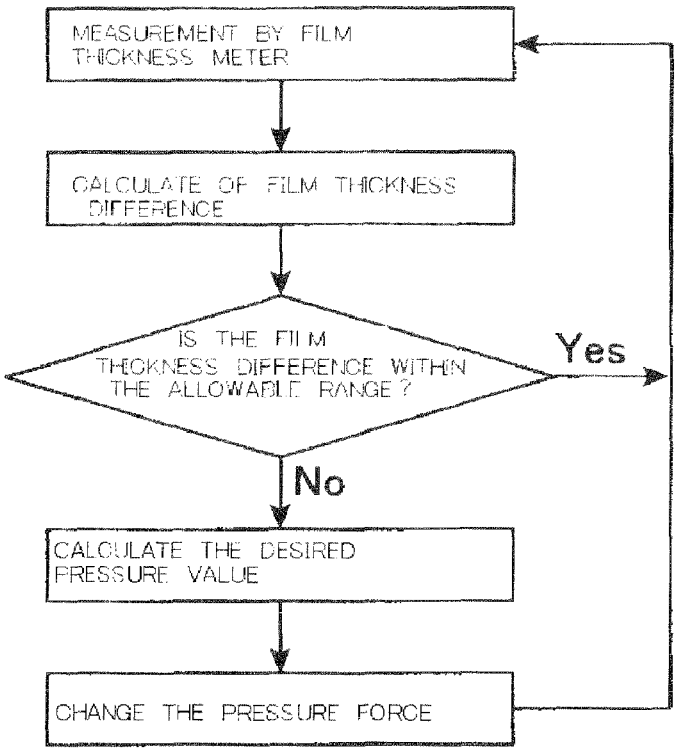
FIG. 5 is a flowchart illustrating a method for adjusting film thickness in an embodiment of the present invention.

Here, an example of the pressure control method (film thickness adjustment method) of this embodiment is explained based on FIG. 5.

Changing the coating film thickness can also be performed by changing the fluid density, however, replacing the fluid takes time, so this method is not suitable for fine adjustment of the film thickness. In order to correspond to quick change in the film thickness, it is effective to automatically change the circumferential speed of the rolls, and perform adjustment of the gap and pressure force between rolls, and at a constant fluid density, the relationship beforehand between the roll coater conditions and the desired film thickness corresponding to the line speed is found, and production is started at the initial values of the roll coater conditions.

More specifically, first the aforementioned initial values of the coater conditions are set for a desired film thickness (for example, 1.0±0.2 μm), and coating is started. In addition, as illustrated in FIG. 5, the film thickness after drying online is measured by a film thickness meter in at least two locations, left and right, in the width direction of the film thickness, and feedback control for updating and adjusting the left and right pressure is performed so that the difference in film thickness at the two locations on the left and right are within an allowable range. By doing so, the film thicknesses of the two locations, left and right, are both set within the desired film thickness.

The method for adjustment when the film thickness greatly deviates from the desired film thickness range on both the left and right in the width direction of the rolls is not illustrated in FIG. 5, however, in many cases the amount of adjustment for correcting just the pressure balance on the left and right of a roll is insufficient, and adjustment can be performed by changing other conditions such as the circumferential speed of the rolls.

Here, measurement of the film thickness can be performed by measuring the film thickness immediately after coating and before drying and then calculating the film thickness value after drying taking into consideration the fluid density, or the dry film thickness can be measured directly. Measurement can also be performed by directly measuring the film thickness, or it is possible to convert to the film thickness value from the analysis value of the adhering amount using an element in the film component, or from an analysis value such as the functional group of resin in the film. For example, using a fluorescence X-ray or infrared film thickness meter is suitable.

An example of feedback control as the method for setting the film thickness to the desired film thickness was mentioned above, however, in this method, the film thickness is made uniform in the width direction of the metal strip by repeatedly performing adjustment by measuring the film thickness in at least two locations, left and right, in the width direction, and when the roll rotates in the reverse direction, increasing the pressure when the film thickness is less than the desired film thickness, and decreasing the pressure when the film thickness is greater than the desired film thickness, until the film thickness becomes the desired film thickness. In a roll coater that performs coating via a plurality of rolls, for example three rolls, in the reverse rotation section, the roll pressure is related to the uniformity in the width direction, in the neutral rotation section, the gap is related to the uniformity in the width direction, however, between the object being coated and the applicator roll, reverse rotation in which it is easy to obtain a uniform film thickness along the metal plate roughness is often used, and the effect of non-uniform film thickness in the width direction due to the shape of the metal plate also occurs due to this gap between the coated object and applicator roll, so adjusting the pressure applied to the object being coated by the applicator roll is effective.

In this way, in this embodiment, adjustment of the pressure can be adjusted individually for the left and right stand while maintaining overall rigidity of the stand that supports the rolls, so it is possible to greatly reduce the time for trial and error when adjusting the film thickness, and to accurately and quickly adjust the pressure so that it is uniform in the width direction of the rolls. As a result, it becomes possible to obtain a uniform coating film thickness in the width direction in a short adjustment time.

In addition, in the embodiment described above, a connecting member movement mechanism 16*a* is provided between the right end of the connecting member 15 and the applicator roll support unit 11*a* in the right stand 1*a*, however, it is possible to provide a connecting member movement mechanism between the left end of the connecting member 15 and the applicator roll support unit 11*b* in the left stand 1*b*, or it is possible to provide a connecting member movement mechanism in both.

Moreover, in the embodiment described above, a connecting member 15 is provided between the applicator roll support unit 11*a* in the right stand 1*a* and the applicator roll support unit 11*b* in the left stand 1*b*, however, it is possible to provide the connecting member between other left and right sites (for example, between the base mounting unit 2*a* of the right stand and the base mounting unit 2*b* of the left stand, or between the pick-up roll support unit 21*a* in the right stand 1*a* and the pick-up roll support unit 21*b* in the left stand 1*b*), and it is possible to provide connecting members at not only one location but a plurality of locations. In that case as well, it is possible to similarly provide a connecting member movement mechanism.

Furthermore, the embodiment above was explained using an example of a single-surface coating type 3-roll coating apparatus, however, the present invention can also be applied to a roll coating apparatus other than this (for example, a 2-roll coating apparatus or double-surface simultaneous roll coating apparatus).

Moreover, the coating fluid that is applied using the roll coating apparatus of the present invention is not particularly limited, and various coatings (coating fluids) such as an organic, inorganic, organic-inorganic composite coating can be used.

As explained above, when compared with the case of producing a coated metal strip using a conventional coating method, in the case of producing a coated metal strip by coating using the roll coating apparatus of the present invention, adjustment of the film thickness at the beginning of the coating process and when there is deviation in the film thickness can be performed in a very short period of time, and even when there is a change in the desired film thickness, it is possible to respond to that change in a short period of time, so there is a decrease in the amount of defective parts due to deviation of the film thickness, and thus yield greatly improves.

Example 1

A first example of the present invention will be explained below.

In this first example, as case 1, the pressure mechanisms 13*a*, 23*a*, 33*a* of the right stand 1*a* are put into operation, and when the applicator roll is pressed against the object being coated with a pressure of 100 kgf on only the side of the right stand 1*a*, the pressure load that was applied on the object being coated by the applicator roll was measured by a pressure load detection device that was provided in the left stand 1*b*. Similarly, as case 2, the pressure mechanisms 13*b*, 23*b*, 33*b* of the left stand 1*b* are put into operation, and when the applicator roll is pressed against the object being coated with a pressure of 100 kgf on only the side of the left stand 1*a*, the pressure load that was applied on the object being coated by the applicator roll was measured by a pressure load detection device that was provided in the right stand 1*b*.

When doing this, the 3-roll coating apparatus illustrated in FIG. 1 and FIG. 2 was used as an example of the invention, and the 3-roll coating apparatus illustrated in FIG. 6 and FIG. 7 was used as a conventional example. In both, the right stand 1*a* was the stand on the drive side.

The results are given in Table 1.

TABLE 1

| | Case 1 Only the right-stand side is pressed | | Case 2 Only the left-stand side is pressed | |
|---|---|---|---|---|
| | Pressure on the right-stand side | Load detected on the left-stand side | Pressure on the left-stand side | Load detected on the right-stand side |
| Conventional example | 100 kgf | 40 kgf | 100 kgf | 30 kgf |
| Invention example | 100 kgf | 0 kgf | 100 kgf | 0 kgf |

As illustrated in Table 1, in the present invention, the pressure force that is transferred to the stand on the opposite side is zero, so it can be seen that it is possible to separately control the pressure force on the left and right side.

Example 2

The 3-roll coating apparatus of the invention (FIG. 1, FIG. 2) and the conventional 3-roll coating apparatus (FIG. 6, FIG. 7) that were used in the first example, are used, and the film thickness was adjusted using the pressure control method illustrated in FIG. 5.

In other words, taking 1.0±0.2 μm to be the desired film thickness, the preset roll coater conditions were set according to the fluid density and line speed, and coating was begun, then after the coating dried, the film thickness was measured online at two locations in the width direction using a film thickness meter, and feedback control was performed to change and adjust the left and right pressure force between the coated object and applicator roll so that the difference in the film thickness at those two locations were within an allowable range. Moreover, by doing this, the time required for setting the film thickness at the two locations on the left and right to be within the range of the desired film thickness (1.0±0.2 μm) was found.

As a result, in the conventional example, the film thickness of the portion that was coated first was measured and it took five minutes from the start of adjustment until the film thickness was within the desired film thickness range; however, in the example of the invention, the film thickness of the portion that was coated first was measured and it was possible to adjust the film thickness to be within the desired film thickness range 10 seconds from the start of adjustment. The line speed was 90 mpm, so the length of the section with bad film thickness in the example of the invention was shortened by 435 m when compared with the conventional example.

In this way, it was confirmed that with the present invention, the film thickness could be set to the desired film thickness in a very short period of time, the length of the defective portion due to deviation in the film thickness was shortened, and the yield was greatly improved.

[Explanation of Reference Numbers]

| | |
|---|---|
| 1a | Right stand |
| 1b | Left stand |
| 2a | Right-stand base mounting unit |
| 2b | Left-stand base mounting unit |
| 9 | Metal strip |
| 10 | Applicator roll |
| 11a | Right-stand applicator roll support unit |
| 11b | Left-stand applicator roll support unit |

-continued

[Explanation of Reference Numbers]

| | |
|---|---|
| 12a | Right-stand applicator roll chock |
| 12b | Left-stand applicator roll chock |
| 13a | Right-stand applicator roll pressure mechanism |
| 13b | Left-stand applicator roll pressure mechanism |
| 14a | Right-stand applicator roll movement mechanism |
| 14b | Left-stand applicator roll movement mechanism |
| 15 | Connecting member |
| 16a | Right-stand connecting member movement mechanism |
| 18a | Right-stand applicator roll pressure detection device |
| 18b | Left-stand applicator roll pressure detection device |
| 20 | Pick-up roll |
| 21a | Right-stand pick-up roll support unit |
| 21b | Left-stand pick-up roll support unit |
| 22a | Right-stand pick-up roll chock |
| 22b | Left-stand pick-up roll chock |
| 23a | Right-stand pick-up roll pressure mechanism |
| 23b | Left-stand pick-up roll pressure mechanism |
| 24a | Right-stand pick-up roll movement mechanism |
| 24b | Left-stand pick-up roll movement mechanism |
| 28a | Right-stand pick-up roll pressure detection device |
| 28b | Left-stand pick-up roll pressure detection device |
| 30 | Metering roll |
| 32a | Right-stand metering roll chock |
| 32b | Left-stand metering roll chock |
| 33a | Right-stand metering roll pressure mechanism |
| 33b | Left-stand metering roll pressure mechanism |
| 34a | Right-stand metering roll movement mechanism |
| 34b | Left-stand metering roll movement mechanism |
| 38a | Right-stand metering roll pressure detection device |
| 38b | Left-stand metering roll pressure detection device |
| 40 | Backup roll |
| 50 | Rolling direct-guiding bearing device |
| 51 | Rail |
| 52 | Rail installation member |
| 53 | Saddle shaped moving member |
| 54 | Bowl |
| 55 | Guide device |
| 56 | Guide member |
| 57 | Moving member |
| 58 | Moving surface |
| 59 | Spring washer |

The invention claimed is:

1. A roll coating apparatus for pressing a roll against a metal strip to coat the metal strip with a coating fluid, comprising:

a connecting member connecting between left and right stands that support left and right ends of the roll, respectively, wherein the connecting member is moveable in a direction of pressure of the roll against the metal strip with respect to at least one of the left and right stands.

2. A method for producing a coated metal strip by using the roll coating apparatus of claim 1 to coat a coating fluid on a surface of a metal strip.

3. The roll coating apparatus according to claim 1, further comprising:

measurement means for measuring film thickness value of a film that is formed on the metal strip; and control means to which the film thickness value and a line speed value are input, and which adjusts a roll circumferential speed, a gap between rolls and a roll pressure so that the film thickness is within a preset range.

4. A method for producing a coated metal strip by using the roll coating apparatus of claim 3 to coat a coating fluid on a surface of a metal strip.

5. A roll coating apparatus for pressing a roll against a metal strip to coat the metal strip with a coating fluid, comprising:

a connecting member connecting between left and right stands that support left and right ends of the roll, respectively, wherein the connecting member is slidable in a direction of pressure of the roll against the metal strip with respect at least one of the left and right stands.

6. The roll coating apparatus according to claim 5, further comprising:

measurement means for measuring film thickness value of a film that is formed on the metal strip; and control means to which the film thickness value and a line speed value are input, and which adjusts a roll circumferential speed, a gap between rolls and a roll pressure so that the film thickness is within a preset range.

7. A method for producing a coated metal strip by using the roil coating apparatus of claim 5 to coat a coating fluid on a surface of a metal strip.

8. A roll coating apparatus for pressing a roll against a metal strip to coat the metal strip with a coating fluid, comprising:

a connecting member connecting between left and right stands that support left and right ends of the roll, respectively; and connecting member movement means provided in a connecting section between the connecting member and at least one of the left and right stands, such that the connecting member is moveable in a direction of pressure of a roll against the metal strip.

9. The roll coating apparatus according to claim 8, further comprising:

measurement means for measuring film thickness value of a film that is formed on the metal strip; and control means to which the film thickness value and a line speed value are input, and which adjusts a roil circumferential speed, a gap between rolls and a roll pressure so that the film thickness is within a preset range.

10. A method for producing a coated metal strip by using the roll coating apparatus of claim 8 to coat a coating fluid on a surface of a metal strip.

11. The roll coating apparatus according to claim 8, wherein the connecting member movement means comprises a rolling self-guiding bearing.

12. The roll coating apparatus according to claim 11, further comprising:

measurement means for measuring film thickness value of a film that is formed on the metal strip; and control means to which the film thickness value and a line speed value are input, and which adjusts a roll circumferential speed, a gap between rolls and a roll pressure so that the film thickness is within a preset range.

13. A method for producing a coated metal strip by using the roll coating apparatus of claim 11 to coat a coating fluid on a surface of a metal strip.

* * * * *